United States Patent [19]

Cohen

[11] 4,362,333

[45] Dec. 7, 1982

[54] SELF-SUPPORTING INFANT CHAIR

[76] Inventor: Daniel E. Cohen, 2515 Cumming Ave., Superior, Wis. 54880

[21] Appl. No.: 232,224

[22] Filed: Feb. 6, 1981

[51] Int. Cl.[3] ..... A47B 39/00

[52] U.S. Cl. ..... 297/174; 297/134

[58] Field of Search ..... 297/174, 134

[56] References Cited

U.S. PATENT DOCUMENTS

| | | | |
|---|---|---|---|
| 3,052,500 | 9/1962 | Hyde | 297/174 X |
| 3,190,691 | 6/1965 | Desjardins | 297/174 |
| 3,243,229 | 3/1966 | Barnhill | 297/174 X |
| 3,253,860 | 5/1966 | Shapiro | 297/174 X |
| 4,248,478 | 2/1981 | Aron | 297/174 |
| 4,312,535 | 1/1982 | Smith | 297/174 |
| 4,322,110 | 3/1982 | Simmons et al. | 297/174 |

FOREIGN PATENT DOCUMENTS

| | | | |
|---|---|---|---|
| 244697 | 8/1962 | Australia | 297/174 |

*Primary Examiner*—William E. Lyddane

*Attorney, Agent, or Firm*—Schwartz & Weinrieb

[57] ABSTRACT

A self-supporting table infant chair includes back, seat, and sidewall portions integrally formed from thermoplastic resin material by means of rotational or injection molding techniques so as to form a one-piece bucket-type chair. An upper set of laterally spaced arms project outwardly from the sidewalls of the chair, while a lower arm projects upwardly out of the seat portion of the chair. The upper and lower arms cooperate so as to define a horizontal channel therebetween within which a projecting portion of a dining table can be disposed and from which the chair will be supported. The upper arms comprise the ends of a C or U-shaped tubular member disposed within a horizontal plane, while the lower arm comprises one end of a C or U-shaped tubular member disposed within a vertical plane, the other end of the tubular member being integrally connected to the central portion of the upper arm member whereby the arm members form a one-piece composite member of substantially T-shaped construction. The T-shaped component may either be embedded or encapsulated within the chair or snap-fitted thereinto, blind fasteners serving as fail-safe or redundant fastening means in conjunction with the snap-fit securement system. Anti-tilt projections are also associated with the chair armrests for supporting the chair upon the table in a stable mode.

19 Claims, 2 Drawing Figures

SELF-SUPPORTING INFANT CHAIR

FIELD OF THE INVENTION

The present invention relates generally to infant chairs, and more particularly to infant chairs which are particularly adapted to be self-supporting from a horizontally disposed table surface.

BACKGROUND OF THE INVENTION

It is usually desirable for a young child to eat at a table at which adults are dining in order to permit one of the adults to assist the child in the eating process, as well as to facilitate the development by the child of socially proper eating habits. While conventional, floor-supported infant chairs, or "high chairs", are of course well known, such chairs do not in fact permit the child to actually dine at the dining table with the adults due to the fact that the elevated seat structure cannot be accommodated beneath the dining table. Consequently, the child does not in fact dine at the dining table with the adults, but only within the vicinity of the table. As a result, proper assistance and instruction for the child is not conveniently administered.

Other infant chairs have of course also been marketed within recent years in order to overcome the aforementioned disadvantages of conventional "high-chairs", and it is particularly noted that one general type of such improved infant chairs is able to be self-supporting from the dining table edge surfaces in a cantilevered manner. As a result of such structure, the child is able to be ideally positioned relative to the dining table in order to facilitate the eating process of the child in a manner quite similar to the eating process performed by the dining adults. Proper development of the socially acceptable dining habits is also of course enhanced.

Such self-supporting chairs usually comprise an upper set of laterally spaced arms, and a lower set of one or more arms which cooperate with the upper set of arms so as to define therebetween a channel into which a projecting edge portion of the dining table is disposed. In this manner, the table surface defines the sole supporting structure for the chair which is, in turn, supported from the dining table in, in effect, a cantilevered manner.

A serious disadvantage of the aforenoted type of self-supporting infant chairs has proven to be the manner in which the support arms are secured to or within the chairs. In such conventional chairs, the arms are often secured to the chair structures simply by means of nut-and-bolt assemblages, wing nut-and-bolt assemblages, and the like. Experience has proven that with usage over extended periods of time, the nut-and-bolt assemblages tend to loosen as the various weight forces and bending moments are impressed thereon, the nuts become lost, and the bolts withdraw. The assemblages are therefore no longer rigidified, and consequently, they become unsafe for the infact child in view of the obvious fact that the chair structures are self-supporting, that is, the originally rigidified structure is the only means whereby the chairs are capable of being supported upon or from the dining tables. The resulting non-rigidified structures obviously can no longer support the loads impressed thereon by means of the infant child's weight, and thus, such structures become dangerous in use and must prudently be avoided and discarded.

In a similar manner, another type of conventional self-supporting infant table chair has the arms thereof secured within the chair framework simply by means of a slidable, friction-type fitting. This mode of securing the arms within the chair framework, however, has likewise proven unsatisfactory in view of the fact that with continued usage over a substantial period of time, the support arms have likewise withdrawn from the support socket structures due to the various stress and weight forces, bending moments, and the like, being impressed thereon. Consequently, such chairs have similarly become dangerous in usage, and must therefore have been avoided or discarded.

OBJECTS OF THE INVENTION

Accordingly, it is an object of the present invention to provide a new and improved infant chair.

Another object of the present invention is to provide a new and improved infant chair of the type which is self-supporting with respect to a horizontally disposed table surface.

Still another object of the present invention is to provide a new and improved self-supporting table infant chair which overcomes the various disadvantages characteristic of conventional self-supporting table infant chairs.

Yet another object of the present invention is to provide a new and improved self-supporting table infant chair wherein, in accordance with one embodiment of the present invention, the support structure for the chair is rigidly secured within the chair framework by means of a fail-safe or redundant fastening system whereby the chair may safely support the infant child.

Still yet another object of the present invention is to provide a new and improved self-supporting table infant chair wherein, in accordance with a second embodiment of the present invention, the support structure for the chair is fixedly encapsulated or embedded within the chair framework whereby the chair may safely support the infant child.

Yet still another object of the present invention is to provide a new and improved self-supporting table infant chair wherein the support structure for the chair is rigidly secured within the chair framework and cannot become disjointed therefrom under normal loads and stresses impressed thereon.

A further object of the present invention is to provide a new and improved self-supporting table infant chair wherein the support structure, while exhibiting a predetermined degree of flexibility in order to permit the chair to be operatively mounted upon the supporting table, is nevertheless rigidly secured within the chair framework so as not to be movable along, or rotatable about, any one of three mutually orthogonal axes.

A still further object of the present invention is to provide a new and improved self-supporting table infant chair wherein the support structure, while exhibiting a predetermined degree of flexibility in order to permit the chair to be operatively mounted upon the supporting table, is nevertheless sufficiently rigid so as to be capable of withstanding bending stresses or moments impressed thereon as a result of the weight load of the infant child or other extraneous forces.

A yet further object of the present invention is to provide a new and improved self-supporting table infant chair wherein the support structure is fabricated of a strong and durable material so as to safely support infant children of various weights.

A still yet further object of the present invention is to provide a new and improved self-supporting table infant chair which may be economically manufactured by mass production techniques.

A yet still further object of the present invention is to provide a new and improved self-supporting table infant chair wherein, in accordance with one embodiment of the present invention, the two primary components of the chair, that is, the chair framework per se and the support structure, may be separately fabricated by mass production techniques and subsequently easily assembled together.

An additional object of the present invention is to provide a new and improved self-supporting table infant chair which is uniquely balanced when supported upon the horizontally disposed table surface so as to inhibit tilting of the chair relative to the table surface when, for example, an infant child load is disposed within the chair.

A still additional object of the present invention is to provide a new and improved self-supporting table infant chair which exhibits high-strength, high impact-resistant, and light-weight characteristics.

SUMMARY OF THE INVENTION

The foregoing and other objectives are accomplished in accordance with the present invention through the provision of a self-supporting table infant chair which comprises seat, back, and side portions integrally formed in a one-piece unit from a suitable thermoplastic resin material, such as, for example, ABS, by means of rotational or injection molding techniques. An upper set of laterally spaced support arms cooperate with a lower support arm so as to define a horizontal channel therebetween within which a projecting portion of a dining table is to be disposed and from which the chair will be supported in a cantilevered manner by means of the support arms.

The upper set of laterally spaced support arms are defined by means of a C or U-shaped tubular member, and the lower support arm is likewise defined by means of a C or U-shaped tubular member with the upper arms being disposed within a horizontal plane while the lower arm member is disposed within a vertical plane. One end of the lower arm member is integrally secured to the central portion of the upper arm member such that the entire support arm structural component is essentially T-shaped.

In accordance with a first embodiment of the present invention, the one-piece chair unit per se may be separately fabricated relative to the one-piece support arm component or unit, and subsequently, the two units may be snap-fitted together. Conventional blind-bore fastening means may also be incorporated within the units so as to serve as a fail-safe or redundant fastening system in conjunction with the snap-fitting system defined between the two units.

In accordance with a second embodiment of the present invention, the entire chair is fabricated as a one-piece unit in view of the fact that the T-shaped support arm component is fixedly encapsulated or embedded within the chair body unit.

In accordance with either embodiment of the present invention, the upper set of support arms are fixedly secured within the chair sidewalls and back portions, while the lower support arm is fixedly secured within the seat and back portions of the chair. Longitudinal and/or rotational movement of the support arms along or about any one of three mutually orthogonal axes is thereby positively prevented. In addition, dependent stop members are integrally formed with the undersurfaces of the chair armrests so as to engage the upper surface of the dining table at locations longitudinally remote from the locations at which the upper support arms engage the table surface. In this manner, tilting of the infant chair relative to the table surface is positively prevented under load conditions.

BRIEF DESCRIPTION OF THE DRAWINGS

Various other objects, features, and attendant advantages of the present invention will be more fully appreciated as the same becomes better understood from the following detailed description when considered in connection with the accompanying drawings, in which like reference characters designate like or corresponding parts throughout the several views, and wherein.

DETAILED DESCRIPTION OF THE ILLUSTRATED EMBODIMENTS

Figure 1:
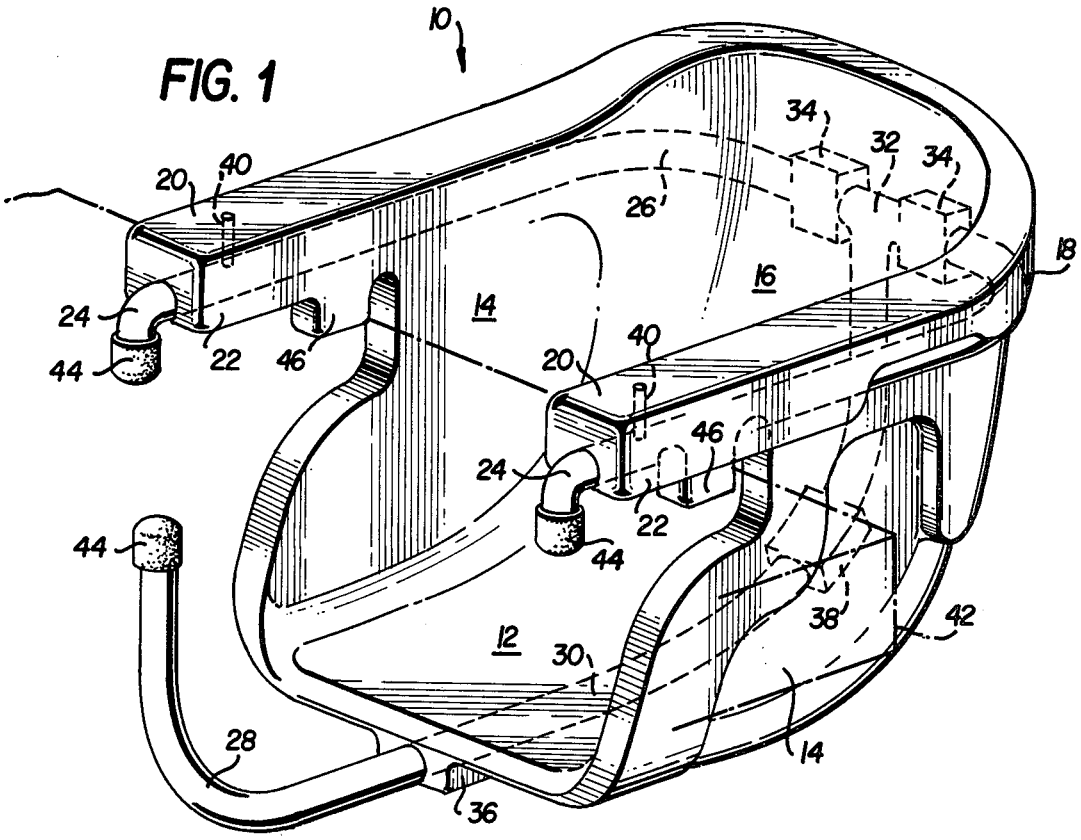
FIG. 1 is a perspective view showing a first embodiment of a self-supporting infant chair constructed in accordance with the present invention and operatively mounted upon a dining table surface.

Referring now to the drawings, and more particularly to FIG. 1 thereof, a first embodiment of a self-supporting table infant chair constructed in accordance with the present invention is disclosed and generally indicated by the reference character 10. As can readily be seen, the chair comprises a one-piece structure of the bucket type and includes a seat portion 12, laterally spaced sidewalls 14, and a back portion 16.

The chair body may be easily fabricated of a suitable thermoplastic resin material by either conventional rotational or injection molding techniques. Such processing enables the chairs to be economically produced by mass production techniques, and in addition, the articles produced exhibit good consistency with respect to each other, and problems do not arise, for example, with respect to the reproduction of chairs of various different colors in order to meet particular consumer demands.

In view of the particular operative mode or environment within which the chair of the present invention is to be utilized, the particular thermoplastic resin material selected must exhibit certain required and desired characteristics, such as, for example, high impact resistance, high strength, light weight, and good appearance and maintenance properties. Polyethylene or polypropylene are satisfactory materials, however, an acrylonitrile-butadiene-styrene (ABS) material is preferred. Such plastic material exhibits good dimensional stability over wide temperature ranges, and the same is characterized by good tensile and flexural strength. The material is commercially available, and one particular type of such material is commercially marketed by the Borg-Warner Chemical Corporation as CYCOLAC T.

The upper portions of the sidewalls 14 and the back portion 16 of the chair are provided with an integrally formed, laterally outwardly projecting beam 18, the forwardmost upper portions of which serve to define armrests 20. The forwardmost undersurfaces of beam 18 serve to define substantially inverted U-shaped socket housings 22 within which the forward ends of upper chair support arms 24 are snap-fittingly engaged. As can be appreciated from FIG. 1, the arms 24 are defined by the ends of a substantially C or U-shaped tubular member 26 which is disposed within a horizontal plane. In a similar manner, the chair of the present invention is likewise provided with a lower support arm 28 which is defined by means of one end of a substantially C or U-shaped tubular member 30 which is disposed within a vertical plane. The opposite end of member 30 is integrally connected to the central portion of member 26, as at 32, such as, for example, by means of a conventional welding process, and in this manner, the support arms of the infant chair of the present invention are defined by means of a single, substantially T-shaped frame member. In order to fixedly secure the rear portion of the T-shaped frame member within the chair body, additional socket housings 34 are provided upon opposite sides of the junction 32 defined between support arm members 26 and 30. In a similar manner, another socket housing 36 is provided upon the manufacture of seat 12 along the centerline thereof and at the forwardmost edge thereof so as to fixedly secure the lower support arm 28 relative to the front edge portion of the chair in a snap-fitting mode. Lastly, yet another socket housing 38 is provided integrally upon the outer surface of the chair 10 at the junction of the seat 12 and back 16 portions of the chair in order to further secure the rear portion of support arm member 30 to the chair body.

As a result of the particular snap-fitting fastening system of the present invention chair, considered of course in conjunction with the fact that the upper and lower support arms 24 and 28 are integrally connected together by means of a one-piece, rigid framework as defined by welded members 26 and 30, movement of the support arm framework relative to the chair body, along any one of three mutually orthogonal axes or rotationally about any one of such axes, is positively prevented once the framework is in fact snap-fitted within the chair body. As a result of such construction, there is no tendency for the support arm framework to become loosened within, and ultimately disjointed from, the chair body. As a fail-safe or redundant fastening system, tubular inserts 40 are housed within each of the snap-fit socket housings 22, 34, 36, and 38, and bolt-type fastening members, not shown, may be mated with the inserts 40 so as to threadedly lock the support arm members 26 and 30 within the socket housings. These two locking or securement systems cooperate with each other in order to assure the fact that the members 26 and 30 remain fixedly secured within the socket housings. For example, as may readily be understood, the bolt-type fastening means, which in effect, define blind-bore type fasteners, serve to retain the tubular members 26 and 30 within the socket housings so that they do not become loosened therewithin and tend to withdraw therefrom, and in a similar manner, the socket housings prevent the tubular members 26 and 30 from moving within the housings and thereby tending to loosen the bolt fastening members. Consequently, the present invention exhibits redundant fastening means or systems.

It will be further appreciated from the disclosure of FIG. 1 that the forward most end portions of upper support arms 24 depend downwardly, while lower support arm 28 of course curves upwardly. In this manner, when the chair of the present invention is adapted to be utilized in its operative mode, that is, mounted upon a dining table 42, it will be seen that the plane of the lowermost ends of arms 24 is disposed somewhat above the uppermost end of lower support arm 28. In this manner, a horizontal channel is defined between the upper arms 24 and the lower arm 28 so as to be capable of accommodating the edge portion of dining table 42 therebetween. The vertical spacing between the planes of arms 24 and 28, and therefore defining the height or depth of the aforenoted channel, is preferably less than the thickness of table 42 such that when the chair is mounted upon the table 42 as a result of the lower ends of arms 24 engaging the upper surface of the table, while the upper end of lower arm 28 engages the undersurface of table 42, the support arms will tightly and frictionally engage the respective surfaces of the table thereby securely mounting the chair 10 upon the table 42. In order to prevent marring of the table surfaces, as well as to increase the frictional engagement of the arms 24 and 28 with respect to the table surfaces, the terminal ends of the arms may be provided with rubber cushion tips or caps 44. In addition, when an infant child is placed within a table-supported chair of this type, it often happens that as a result of the weight load conditions impressed upon chairs of this type, some tilting or pivoting of the chair is experienced about, for example, the engagement locations as defined by means of the terminal ends of arms 24 and the table 42. In order to eliminate or reduce this tendency to a substantial degree, and therefore provide a chair which exhibits a high degree of stability under such load conditions, the undersurfaces of the socket housings 22 associated with the upper support arms 24 are provided with dependent projections or stop members 46. These members will likewise engage the upper surface of table 42 at locations rearwardly remote from the terminal ends of support arms 24, and consequently, will prevent tilting or pivoting of the chair about the upper support arm-table engagement locations. A last feature to be noted herein in connection with the particular structure of the support arms is the fact that with respect to lower support arm 28, the arcuate, and forwardly-projecting extent, of arm 28 is such that the chair of the present invention is able to easily be mounted upon and accommodate itself to a table which has a dependent, or vertically disposed, skirt, not shown.

As noted hereinabove, the support arm members 26 and 30 are fabricated of metal tubing, and the particular metal chosen may be, for example, steel, aluminum, chrome-plated steel, or the like. It is desirable to render the support arms as light in weight as is possible, yet of sufficient strength capable of withstanding the various bending moments and stresses, as well as weight and extraneous force loads, which will undoubtedly be impressed upon such support arm structure during the operative use of the chair. It has been found for example, that while steel is heavier than aluminum, the strength properties of steel are greater than those of aluminum. Consequently, in fabricating the tubular members employed in making the support arms of the chair of the present invention, the wall thickness of the tubing may be less in the case of steel tubing than that of aluminum tubing as the latter must have greater wall thickness dimensions in order to exhibit similar strength properties of steel tubing. Such considerations can be accounted for in selecting the tubing to be utilized.

Figure 2:
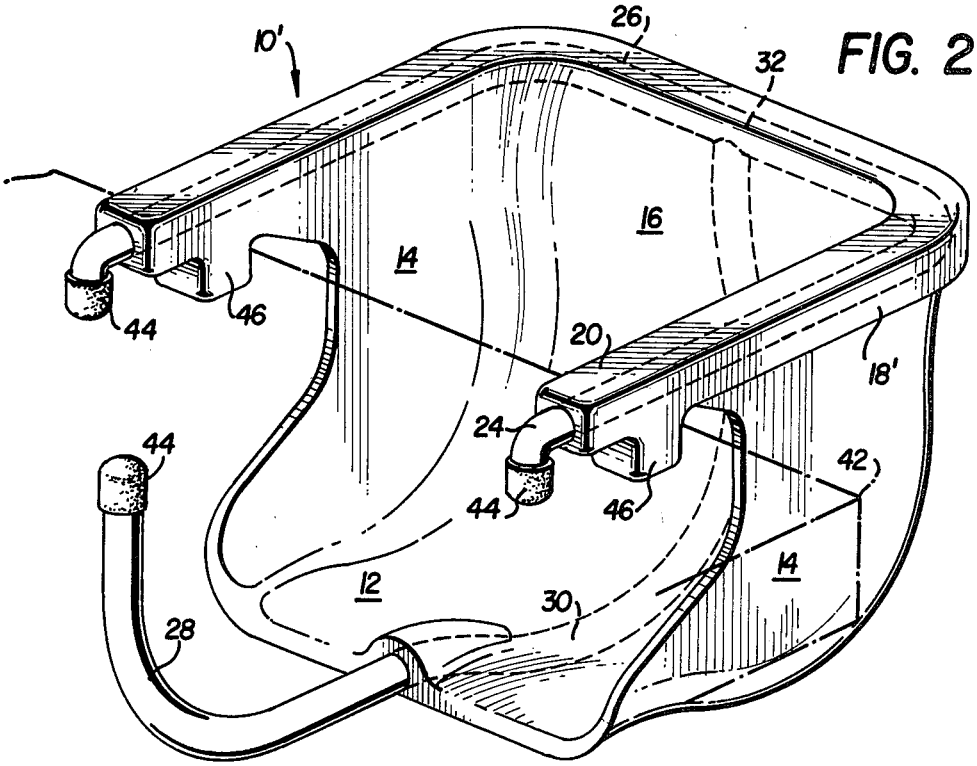
FIG. 2 is a perspective view showing a second embodiment of a self-supporting infant chair constructed in accordance with the present invention and operatively mounted upon a dining table surface.

Referring now to FIG. 2, a second embodiment of a self-supporting table infant chair constructed in accordance with the present invention is disclosed and generally indicated by the reference character 10'. The chair of this embodiment is substantially identical to that of FIG. 1, with the exception that the perimetrical beam 18′ is somewhat different from the beam 18 of the chair 10 of FIG. 1, and in lieu of the snap-fitting attachment structure for securing the support arm framework within the chair body as was characteristic of the embodiment of FIG. 1, it is seen that the support arm framework comprising tubular members 26 and 30 is completely embedded or encapsulated within the thermoplastically molded chair body. It is of course to be appreciated that the thickness of the molded chair portions comprising the seat 12 and back 16 are sufficient so as to completely encapsulate or embed tubular member 30 therewithin.

Obviously, many modifications and variations of the present invention are possible in light of the above teachings, and therefore, it is to be understood that within the scope of the appended claims, the present invention may be practiced otherwise than as specifically described herein.

What is claimed as new and desired to be secured by Letters Patent of the United States is:

1. An infant chair adapted to be self-supporting from a horizontally disposed table surface, comprising:
   a seat portion, a back portion, and a pair of sidewall portions;
   first support arm means comprising a single frame member defining a pair of arms projecting outwardly from said sidewall portions of said chair, and a rear portion operatively associated with said back portion of said chair;
   second support arm means projecting outwardly from said seat portion of said chair;
   said first and second support arm means defining a horizontal channel therebetween within which said table surface is to be disposed and for engaging the upper and under surfaces of said table respectively; and
   said second support arm means being integrally connected to said rear portion of said first support arm means single frame member so as to form a one-piece support arm framework for supporting said chair from said table surface.

2. An infant chair as set forth in claim 1, wherein:
   said one-piece support arm framework is removable from said chair as a one-piece unit.

3. An infant chair as set forth in claim 1, further comprising:
   means for mounting said one-piece support arm framework upon said chair in a snap-fitting mode.

4. An infant chair as set forth in claim 3, further comprising:
   fastening means operatively cooperating with said snap-fitting mounting means for retaining said support arm framework upon said chair.

5. An infant chair as set forth in claim 3, further comprising:
   armrest means integrally formed with said sidewall portions of said chair.

6. An infant chair as set forth in claim 5, wherein:
   said snap-fitting mode means comprises sockets defined within said armrest means.

7. An infant chair as set forth in claim 5, further comprising:
   means connected to the undersurfaces of said armrest means for preventing tilting of said chair relative to said table surface under load conditions, said anti-tilting means engaging the upper surface of said table at a location rearwardly of said engagement locations defined between said first support arm means and said table.

8. An infant chair as set forth in claim 1, wherein:
   said one-piece support arm framework is fixedly embedded within said seat and sidewall portions of said chair.

9. An infant chair as set forth in claim 1, further comprising:
   said back, seat, and sidewall portions are integrally formed as a one-piece structure.

10. An infant chair as set forth in claim 9, wherein:
   said one-piece chair structure is rotationally molded.

11. An infant chair as set forth in claim 9, wherein:
   said one-piece chair structure is injection molded.

12. An infant chair as set forth in claims 10 or 11, wherein:
   said chair structure is fabricated from a thermoplastic resin material.

13. An infant chair as set forth in claim 12, wherein:
   said thermoplastic resin material is ABS.

14. An infant chair as set forth in claim 1, further comprising:
   means secured to one of said first and second support arm means for preventing marring of said table surfaces.

15. An infant chair as set forth in claim 14, wherein:
   said marring preventing means comprises rubber caps.

16. An infant chair as set forth in claim 1, wherein:
   said first and second support arm means comprise tubular members.

17. An infant chair as set forth in claim 16, wherein:
   said tubular members are fabricated from chrome-plated steel.

18. An infant chair as set forth in claim 16, wherein:
   said first support arm means comprises a U-shaped tubular member disposed within a horizontal plane.

19. An infant chair as set forth in claim 18,
   said second support arm means comprises a U-shaped tubular member disposed within a vertical plane with one end thereof welded to the central portion of said first support arm U-shaped member.

* * * * *